US005369379A

United States Patent [19]

Fujiki

[11] Patent Number: 5,369,379

[45] Date of Patent: Nov. 29, 1994

[54] CHIP TYPE DIRECTIONAL COUPLER COMPRISING A LAMINATED STRUCTURE

[75] Inventor: Yasuhiro Fujiki, Nagaokakyo, Japan

[73] Assignee: Murata Mfg., Co., Ltd., Japan

[21] Appl. No.: 986,777

[22] Filed: Dec. 8, 1992

[30] Foreign Application Priority Data

Dec. 9, 1991 [JP] Japan ..... 3-324771

[51] Int. Cl.[5] ..... H01P 5/18

[52] U.S. Cl. ..... 333/116; 333/246

[58] Field of Search ..... 333/116, 115, 117, 246

[56] References Cited

U.S. PATENT DOCUMENTS 4,821,007 4/1989 Fields et al. ..... 333/116 X
5,032,803 7/1991 Koch ..... 333/116

FOREIGN PATENT DOCUMENTS 2457644 7/1975 Germany ..... 333/116
214602 10/1985 Japan ..... 333/116
1192000 11/1985 U.S.S.R. ..... 333/116

*Primary Examiner*—Benny Lee

*Attorney, Agent, or Firm*—Ostrolenk, Faber, Gerb & Soffen

[57] ABSTRACT

Disclosed herein is a chip type directional coupler comprising a laminated structure of a plurality of dielectric substrates, each dielectric substrate having a pair of stripline electrodes nonlinearly formed on its one major surface in parallel with each other, and a plurality of ground electrode substrates, each ground electrode substrate being provided with a ground electrode on its one major surface, the dielectric and ground electrode substrates being so alternately stacked that uppermost and lowermost layers are defined by the ground electrodes, and a plurality of external electrodes which are formed on side surfaces of the laminated structure. The pairs of stripline electrodes formed on the respective dielectric substrates are connected in series with each other through the intervening dielectric substrates, to define stripline electrodes of quarter wavelengths in overall length. Both ends of the quarter-wavelength stripline electrodes and the ground electrodes are electrically connected to different ones of the external electrodes.

7 Claims, 6 Drawing Sheets

CHIP TYPE DIRECTIONAL COUPLER COMPRISING A LAMINATED STRUCTURE

CROSS REFERENCE TO RELATED APPLICATION

This application is related to commonly-assigned Ser. No. 07/981,074 filed Nov. 24, 1992, now pending.

BACKGROUND OF THE INVENTION

1. Field of the Invention

The present invention relates to a chip type directional coupler employing striplines.

2. Description of the Background Art

In order to manufacture a waveguide circuit, which has been a staple component of microwave circuits, highly precise machining is required. Therefore, such a waveguide circuit is unsuitable for mass production, and is high-priced, large-sized and heavy. In a radio set or a BS (broadcast satellite) receiver, therefore, microstrips or striplines are employed for implementing miniaturization and weight reduction through a high integration technique.

A directional coupler is a circuit element which is adapted to provide an output which is proportional to only unidirectional power from a source of microwave power flowing through a transmission line without reference to reverse power. FIG. 5 shows a conventional quarter-wavelength coupled-line directional coupler, which is formed by striplines 40 and 41. Referring to FIG. 5, microstripline electrodes 40*a* and 41*a* of the striplines 40 and 41 are partially close to each other horizontally over a length of $\lambda/4$, where $\lambda$ represents a wavelength.

Due to the coupling mode of the portions which are horizontally close to each other over the aforementioned length of $\lambda/4$, a fraction of the power which is applied to the principal line at a port 1 is produced at a port 3 of the secondary line.

Referring to FIG. 5, the stripline electrodes 40*a* and 41*a* are shielded by ground electrodes 42 and 43, shown with two-dot chain lines, which are arranged to enclose the stripline electrodes 40*a* and 41*a* on upper and lower sides thereof while being insulated from the stripline electrodes.

A function of such a directional coupler, which may be for halving a high frequency signal, for example, may be applied to a portable telephone, for example, for minimizing its transmission power. As shown in FIG. 6, a principal line 50*a* of such a directional coupler 50 is arranged between a transmission power amplifier 51 and an antenna 52 while an end of a secondary line 50*b* is connected to an automatic gain control circuit 53, to control the power of the transmission power amplifier 51 by means of the automatic gain control circuit 53.

However, it is important to further miniaturize the aforementioned portable telephone, and hence further miniaturization is required also for the directional coupler. As hereinabove described, each stripline electrode requires a length of $\lambda/4$, e.g., 7.5 cm at 1 GHz with a dielectric constant of 1. In order to couple linear stripline electrodes having such lengths, a substrate having a relatively wide area is required.

SUMMARY OF THE INVENTION

In consideration of the aforementioned circumstances, an object of the present invention is to provide a further miniaturized chip type directional coupler.

A chip type directional coupler according to the present invention comprises a laminated structure of a plurality of dielectric substrates, each having a pair of stripline electrodes nonlinearly formed on its one major surface in parallel with each other, and a plurality of ground electrode substrates, each being provided with a ground electrode on its one major surface, which are alternately stacked so that uppermost and lowermost layers are defined by the ground electrodes, and a plurality of external electrodes which are formed on side surfaces of the laminated structure. The pairs of stripline electrodes provided on the respective dielectric substrates are connected in series with each other through the dielectric substrates to define stripline electrodes which are a quarter wavelength in overall length. Both ends of the quarter-wavelength stripline electrodes and the ground electrodes are electrically connected to different ones of the external electrodes.

According to the aforementioned structure, the quarter-wavelength stripline electrode portions are obtained by the total lengths of the stripline electrodes which are formed on the plurality of dielectric substrates, whereby the distances to be covered by the striplines provided on each dielectric substrate can be reduced in inverse proportion to the number of the dielectric substrates. Thus, it is possible to miniaturize the chip type directional coupler by reducing the areas of the respective dielectric substrates. Since the stripline electrodes are nonlinearly formed on the dielectric substrates, it is possible to further reduce the areas of the substrates as compared with those provided with linear stripline electrodes.

Further, the stripline electrodes are enclosed between the ground electrodes so as to be shielded in the upper and lower directions, whereby an electromagnetic shielding structure can be implemented by the laminated structure with no requirement of a metal case. In addition, the directional coupler can be surface-mounted on a substrate, since the external electrodes are formed on side surfaces thereof.

The foregoing and other objects, features, aspects and advantages of the present invention will become more apparent from the following detailed description of an embodiment of the present invention when taken in conjunction with the accompanying drawings.

Figure 5:
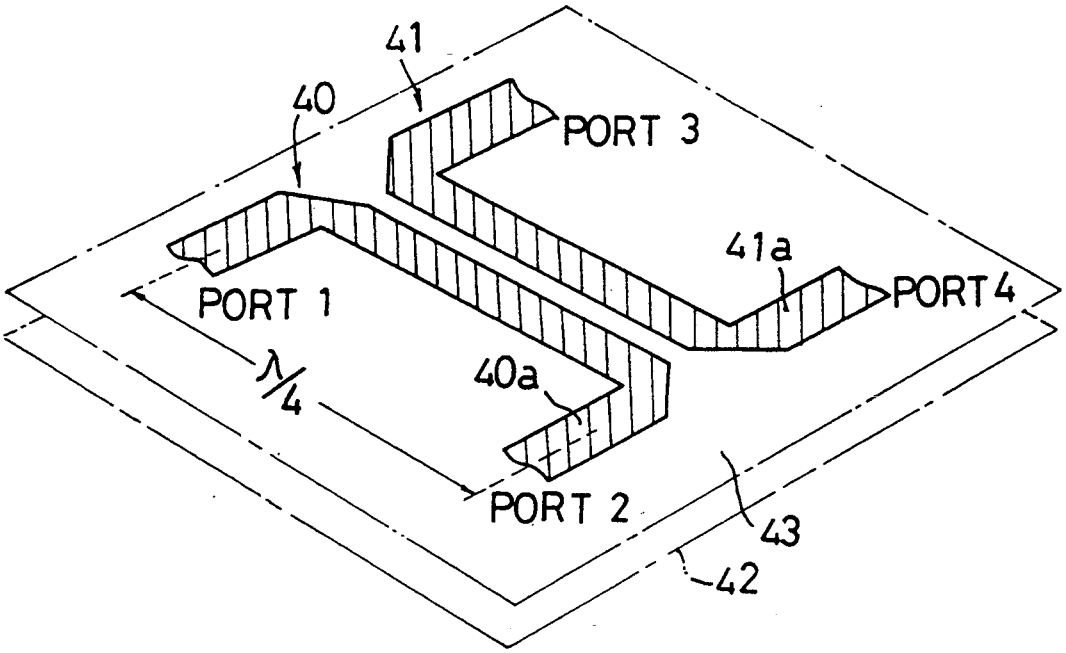
FIG.5 PRIOR ART
Figure 6:
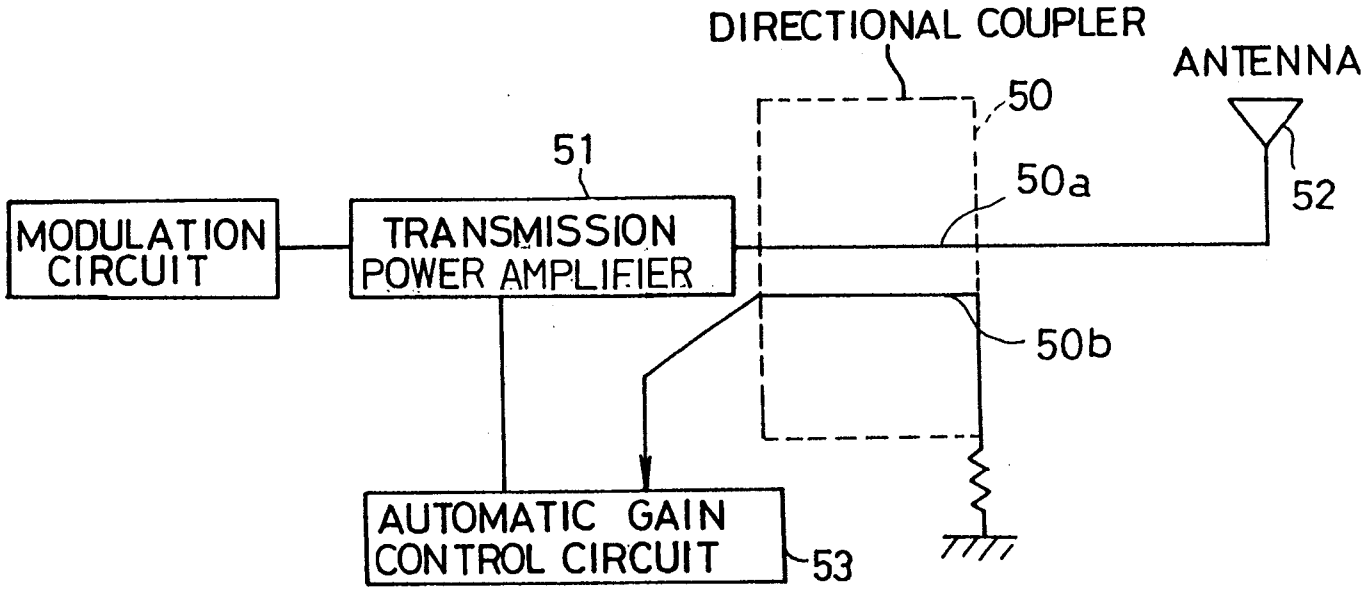
FIG.6 PRIOR ART

FIG. 5 is a perspective view showing a conventional broadside coupling type directional coupler; and FIG. 6 is a block diagram showing an RF transmission circuit employing a directional coupler.

DESCRIPTION OF THE PREFERRED EMBODIMENTS

An embodiment of the present invention is now described with reference to FIGS. 1 to 4C.

Figure 1:
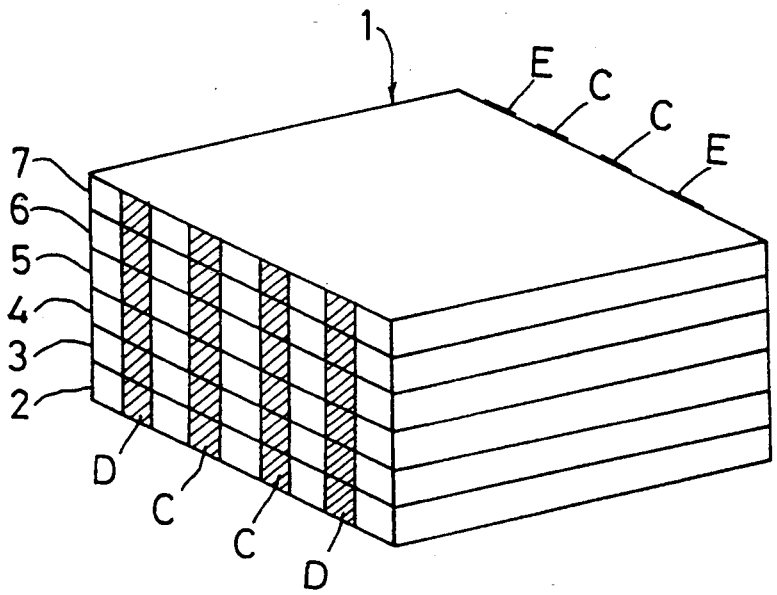
FIG. 1 is a perspective view showing a chip type directional coupler according to an embodiment of the present invention.

FIG. 1 is a perspective view showing the appearance of a chip type directional coupler 1. This chip type directional coupler 1 has a laminated structure which is formed by stacking a first ground electrode substrate 2, a first stripline electrode substrate 3, a second ground electrode substrate 4, a second stripline electrode substrate 5, a third ground electrode substrate 6, and a protective substrate 7. The laminated structure is provided on its side surface with external electrodes C, D and E for ground electrodes, a secondary line and a principal line respectively. In practice, the substrates 2 to 7 are formed of ceramic green sheets, which are first provided with respective electrode films and then stacked with each other. The green laminate obtained in this way is provided with the external electrodes C, D and E on its side surfaces, and thereafter sintered to form the coupler 1. In practice, therefore, no separation lines appear between the layers of the respective substrates 2 to 7 shown in FIG. 1. The external electrodes C, D and E may be formed by applying conductive paste to the laminate and baking the same, or by plating or evaporation after firing the laminate of the ceramic green sheets.

Figure 2:
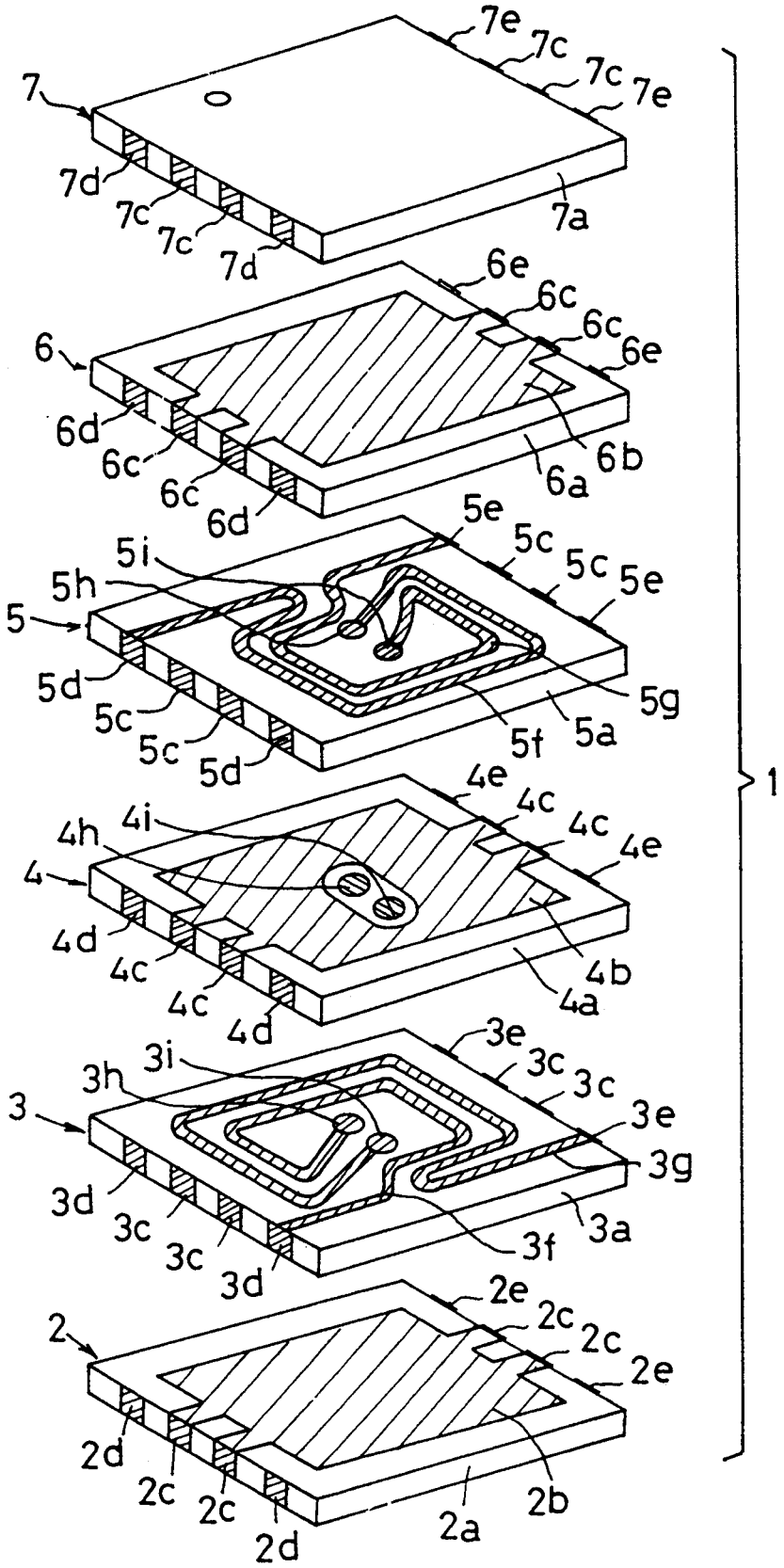
FIG. 2 is an exploded perspective view illustrating respective substrates in the chip type directional coupler shown in FIG. 1.

As understood from FIG. 2, which shows an exploded perspective view of the directional coupler 1 shown in FIG. 1, the first ground electrode substrate 2 is formed by a square ceramic substrate 2*a* and a ground electrode 2*b* provided on one major surface thereof. The ground electrode 2*b* is sized to be capable of covering stripline electrodes 3*f* and 3*g* as described later. This ground electrode 2*b* is not formed over the entire major surface of the ceramic substrate 2*a*. In other words, the ground electrode 2*b* is not formed on a peripheral edge portion of the substrate 2*a*, to be prevented from electrical connection with external electrodes 2*d* and 2*e* as described below. The ceramic substrate 2*a* is provided on its side surfaces with external electrodes 2*c*, 2*d* and 2*e*. The external electrodes 2*c* are electrically connected with the ground electrode 2*b*, while the external electrodes 2*d* and 2*e* are not electrically connected with the ground electrode 2*b*, as hereinabove described.

The first stripline electrode substrate 3 is formed by a square ceramic substrate 3*a* and stripline electrodes 3*f* and 3*g*, which are adapted to define parts of secondary and principal lines respectively, provided on one major surface of the ceramic substrate 3*a*. An end of the stripline electrode 3*f* is connected to a right one of external electrode portions 3*d* which are formed on a side surface of the substrate 3*a* in correspondence to the external electrodes 2*d*, while the other end is connected to a land portion 3*h* which is formed in a substantially central portion of the substrate 3*a*. On the other hand, an end of the stripline electrode 3*g* is connected to a right one of external electrode portions 3*e* which are formed on another side surface of the substrate 3*a* in correspondence to the external electrode portions 2*e*, while the other end is connected to another land portion 3*i* which is formed in proximity to the aforementioned land portion 3*h*. Such stripline electrodes 3*f* and 3*g* encounter each other substantially at the center of a line connecting the right external electrode portions 3*d* and 3*e* in FIG. 2, and then meanderingly extend closely in parallel with each other, to reach the land portions 3*h* and 3*i* respectively. The stripline electrodes 3*f* and 3*g* thus closely travel in parallel with each other by an interval corresponding to a distance substantially half the quarter wavelength. External electrode portions 3*c* are formed at respective locations on both side surfaces of the substrate 3*a* corresponding to the external electrodes 2*c*.

The second ground electrode substrate 4, which is similar in structure to the aforementioned first ground electrode substrate 2, has a square ceramic substrate 4*a*, a ground electrode 4*b*, and external electrode portions 4*c* and 4*e*. The substrate 4*a* is provided with no ground electrode on a substantially central portion thereof, and via holes 4*h* and 4*i* are formed substantially at the center of such a non-electrode region in positions corresponding to the aforementioned land portions 3*h* and 3*i* and filled up with conductive paste for serving as conductive paths.

The second stripline electrode substrate 5, which is substantially similar in structure to the first stripline electrode substrate 3, has a square ceramic substrate 5*a*, stripline electrodes 5*f* and 5*g*, external electrodes 5*c*, 5*d* and 5*e* and land portions 5*h* and 5*i*. An end of the stripline electrode 5*f* is connected to the left one of the external electrodes 5*d*, while an end of the stripline electrode 5*g* is connected to the left one of the external electrodes 5*e* in FIG. 2. Via holes are formed under the land portions 5*h* and 5*i* and filled up with conductive paste for serving as conductive paths, so that the land portions 5*h* and 5*i* are electrically connected with the land portions 3*h* and 3*i* through these via holes and the aforementioned via holes 4*h* and 4*i* respectively.

While the stripline electrode 3*f* of the first stripline electrode substrate 3 is formed within the stripline electrode 3*g*, the stripline electrode 5*f* is formed outside the stripline electrode 5*g*. Correspondingly, the stripline electrode 5*g* is formed within the stripline electrode 5*f* while the stripline electrode 3*g* is formed outside the stripline electrode 3*f*. Thus, the total distance (interval of close parallel traveling) covered by the stripline electrodes 3*f* and 5*f* is strictly identical to that of the stripline electrodes 3*g* and 5*g*.

The third ground electrode substrate 6, which is identical in structure to the aforementioned first ground electrode substrate 2, has a square ceramic substrate 6*a*, a ground electrode 6*b*, and external electrode portions 6*c*, 6*d* and 6*e*.

The protective substrate 7 is formed by a square ceramic substrate 7*a*. External electrode portions 7*c*, 7*d* and 7*e* corresponding to the external electrode portions 2*c*, 2*d* and 2*e* are positioned on side surfaces of the protective substrate 7 respectively.

The external electrodes of the respective substrates 2 to 7 are formed by a well-known method after the substrates 2 to 7 are stacked and compression-molded to each other. Therefore, the external electrodes C for the ground electrodes are defined by the external electrode portions 2*c* to 7*c* and the external electrodes D for the secondary line are defined by the external electrode portions 2*d* to 7*d*, while the external electrodes E for the principal line are defined by the external electrode portions 2*e* to 7*e* respectively, as shown in FIG. 1.

According to the aforementioned structure, the directional coupler 1 is formed by a pair of quarter-wavelength stripline electrode portions which are defined by the continuous stripline electrodes 3*f* and 5*f* as well as 3*g* and 5*g* in the first and second stripline electrode substrates 3 and 5 held between the first, second and third ground electrode substrates 2, 4 and 6.

In this case, the quarter-wavelength stripline electrode portions are obtained in the total distances of the stripline electrodes 3*f*, 5*f*, 3*g* and 5*g* formed on the two stripline electrode substrates 3 and 5, whereby the stripline electrodes formed on each stripline electrode substrate are needed to cover only a distance corresponding to a half of the quarter wavelength. Thus, it is possible to miniaturize the chip type directional coupler 1 by reducing the areas of the stripline electrode substrates. Since the stripline electrodes are meanderingly formed on the stripline electrode substrates, the substrate areas can be further reduced as compared with those provided with linear stripline electrodes.

The ground electrodes 2*b*, 4*b* and 6*b* are adapted to vertically hold the stripline electrodes therebetween, whereby the stripline electrodes are shielded from upper and lower directions. Thus, it is possible to implement an electromagnetic shielding structure by the laminated structure, with no requirement for a metal case. Further, the chip type directional coupler 1 can be surface-mounted on a substrate, since the external electrodes C, D and E are provided on its side surfaces.

A method of manufacturing the aforementioned chip type directional coupler 1 is now briefly described. A green sheet, corresponding to the second ground electrode substrate, printed with a ground electrode is held between green sheets which are provided with stripline electrodes, and green sheets provided with ground electrodes are further stacked on upper and lower surfaces thereof. Then, a green sheet for serving as the protective substrate is further stacked on the thus-formed laminate, which in turn is integrally fired after application of respective external electrodes. Such external electrodes may alternatively be formed after the firing step, as a matter of course.

Figure 3:
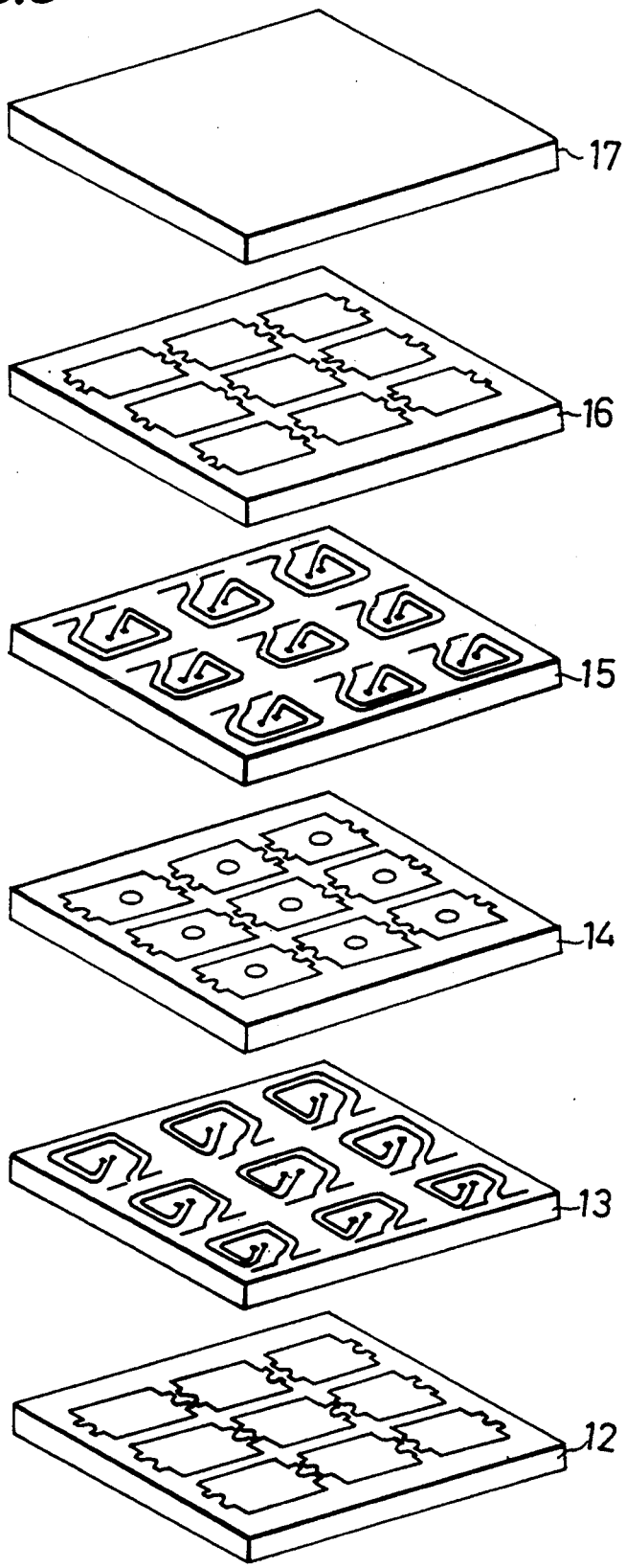
FIG. 3 is a perspective view showing respective substrates employed for mass-producing chip type directional couplers.
Figure 4A:
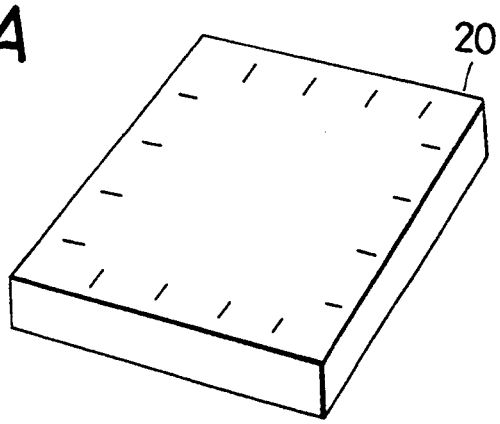
FIG. 4A is a perspective view illustrating a laminated substrate formed by the substrates shown in FIG. 3.
Figure 4B:
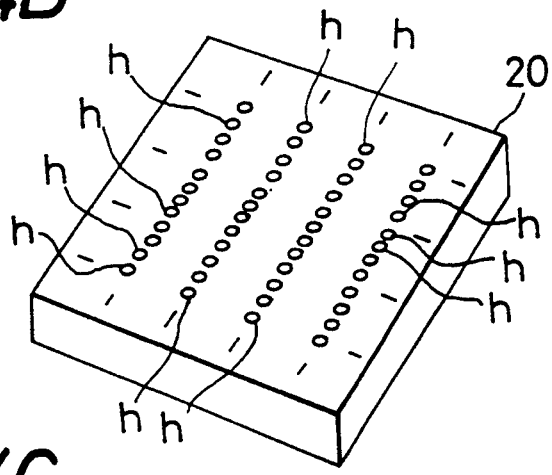
FIG. 4B is a perspective view showing a state of the laminated substrate provided with through holes.
Figure 4C:
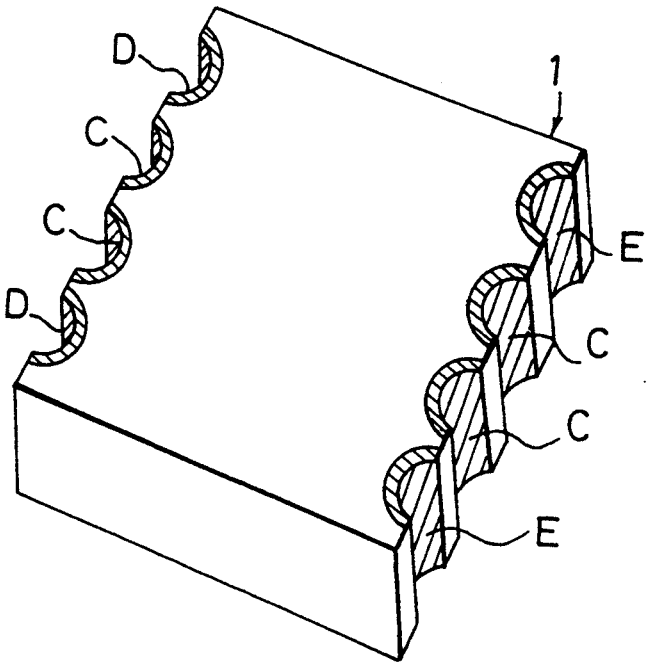
FIG. 4C is an enlarged perspective view showing one of a plurality of chip type directional couplers obtained by cutting the laminated substrate shown in FIG. 4B along prescribed cutting lines after injecting a metal into the through holes.

While the dielectric substrates may arbitrarily be formed by a resin, a ceramic or a glass fluorine substrate, the use of a ceramic can suppress power loss of the principal line since a ceramic has smaller dielectric loss than glass epoxy resin etc. as described below and is excellent in heat radiation for attaining further miniaturization, while a glass fluorine substrate also has the advantage of small dielectric loss.

glass epoxy resin: $\tan \delta = 0.02$ exemplary ceramic dielectric: $\tan \delta = 0.0007$ Such chip-type directional couplers can be mass-produced by the following manufacturing method: As shown in FIG. 3, a sheet 12 provided with a plurality of ground electrodes, a sheet 13 provided with a plurality of pairs of stripline electrodes, a sheet 14 provided with a plurality of ground electrodes, a sheet 15 provided with a plurality of pairs of stripline electrodes, a sheet 16 printed with a plurality of ground electrodes and a sheet 17 for defining protective substrates are stacked to obtain a laminated substrate 20 shown in FIG. 4A. In such a laminated state, as seen in FIG. 2, the land portions 5*h* and 5*i* are already electrically connected with the land portions 3*h* and 3*i* through the via holes 4*h* and 4*i* respectively. Then, through holes h are formed in portions for defining external electrodes as shown in FIG. 4B, a metal for defining electrodes is injected into the through holes h, and the laminated substrate 20 is cut along prescribed cutting lines. Each cut piece is fired to obtain a chip type directional coupler 1 provided with external electrodes C, D and E on its side surfaces, as shown in FIG. 4C.

While two stripline electrode substrates are employed in this embodiment to form quarter-wavelength stripline electrode portions over two layers, it is possible to further miniaturize the chip type directional coupler by employing a larger number (e.g., three or four) of stripline electrode substrates for forming quarter-wavelength stripline electrode portions over three or more layers.

A linear portion of each stripline electrode forms a general type of stripline which does not serve as a coupler, and the line width thereof is designed or set to attain a characteristic impedance of 50 Ω. Since this line width is different from that of the quarter-wavelength stripline electrode portion, a tapered portion is preferably formed therebetween to cause no electric discontinuity, thereby reducing reflection.

Further, it is possible to minimize reflection caused by the bending of the quarter-wavelength stripline electrode portions by maximally meandering the quarter-wavelength stripline electrode portions along the peripheral edge portions of the ground electrodes within the range of formation thereof.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A chip type directional coupler comprising:

a laminated structure including a plurality of dielectric substrates, each dielectric substrate having a pair of stripline electrodes nonlinearly disposed in parallel with each other on one major surface thereof, and a plurality of ground electrode substrates, each ground electrode substrate being provided with a ground electrode on one major surface thereof, each ground electrode having two ends, said dielectric substrates and said ground electrode substrates being alternately stacked so that uppermost and lowermost layers are defined by respective ones of said ground electrode substrates; and said laminated structure having side surfaces, and a plurality of external electrodes disposed on said side surfaces of said laminated structure, said pairs of stripline electrodes disposed on respective said dielectric substrates being connected in series with each other through said ground electrode substrates interposed therebetween to define a pair of stripline electrodes each having a predetermined overall electrical length and each having two ends, both ends of said stripline electrodes and said ground electrodes respectively being electrically connected to different ones of said external electrodes.

2. A chip type directional coupler in accordance with claim 1, wherein said laminated structure is a sintered body comprising a cofired stack of a plurality of ceramic green sheets which define said dielectric substrates and said ground electrode substrates.

3. A chip type directional coupler in accordance with claim 1, wherein said ground electrodes have a size so as to cover said stripline electrodes disposed on said dielectric substrates with respect to a direction through the respective major surfaces of said dielectric and ground substrates of said laminated structure.

4. A chip type directional coupler in accordance with claim 1, wherein each of said pairs of stripline electrodes disposed on said respective dielectric substrates extend to reach different side surfaces of said laminated structure.

5. A chip type directional coupler in accordance with claim 1, wherein said laminated structure further comprises a protective substrate being arranged on the uppermost one of said ground electrode substrates.

6. A chip type directional coupler in accordance with claim 1, wherein said dielectric substrates comprise ceramics.

7. A chip type directional coupler in accordance with claim 1, wherein said chip type directional coupler is operable at a predetermined wavelength and said overall electrical length of each stripline electrode is a quarter of said wavelength.

* * * * *